US012295427B2

(12) United States Patent
Wenkman

(10) Patent No.: US 12,295,427 B2
(45) Date of Patent: May 13, 2025

(54) SHIRT WITH ANTI-FLAP PLACKET CLOSURE DEVICE AND KIT FOR MAKING THE SAME

(71) Applicant: American Brands LLC, Phoenix, AZ (US)

(72) Inventor: William S. Wenkman, Phoenix, AZ (US)

(73) Assignee: American Brands LLC, Phoenix, AZ (US)

( * ) Notice: Subject to any disclaimer, the term of this patent is extended or adjusted under 35 U.S.C. 154(b) by 0 days.

(21) Appl. No.: 17/963,753

(22) Filed: Oct. 11, 2022

(65) Prior Publication Data

US 2023/0115016 A1 Apr. 13, 2023

Related U.S. Application Data

(60) Provisional application No. 63/254,298, filed on Oct. 11, 2021.

(51) Int. Cl.
*A41B 1/10* (2006.01)

(52) U.S. Cl.
CPC ..... *A41B 1/10* (2013.01)

(58) Field of Classification Search
CPC .... A41B 3/08; A41B 1/10; A41B 1/18; A41B 2300/30; G09F 2003/0208
See application file for complete search history.

(56) References Cited

U.S. PATENT DOCUMENTS

| | | | | | |
|---|---|---|---|---|---|
| 139,937 | A | * | 6/1873 | Wieser | A41B 1/02 2/118 |
| 146,175 | A | | 1/1874 | Flynt | |
| 148,193 | A | | 3/1874 | Dunbar | |
| 270,087 | A | * | 1/1883 | Lynch | A41B 1/10 D2/849 |
| 388,075 | A | | 8/1888 | Saeger | |
| 510,639 | A | | 12/1893 | Ganson | |
| 730,137 | A | | 6/1903 | Livingston | |
| 925,121 | A | | 6/1909 | Melze | |
| 932,640 | A | | 8/1909 | Pfiffner | |
| 948,199 | A | | 2/1910 | Anderson | |
| 959,441 | A | | 5/1910 | Anderson | |
| 1,199,689 | A | | 9/1916 | Gewandter | |
| 1,534,174 | A | * | 4/1925 | Frank | A41B 1/10 2/265 |
| 1,764,212 | A | | 6/1930 | Frederick | |
| 1,883,341 | A | | 10/1932 | Dauphinais | |
| 1,998,085 | A | | 4/1935 | Wilcox | |
| 2,306,088 | A | | 12/1942 | Spanney | |
| 2,585,689 | A | | 2/1952 | Schafer | |
| 2,646,570 | A | | 7/1953 | Rinehart | |
| 2,671,222 | A | | 3/1954 | Hochberg | |
| 2,686,915 | A | * | 8/1954 | Gatto | A41B 1/10 2/128 |
| 2,893,012 | A | | 7/1959 | Kahn | |

(Continued)

*Primary Examiner* — Jillian K Pierorazio
(74) *Attorney, Agent, or Firm* — Joseph T. Leone; DeWitt LLP

(57) ABSTRACT

A motorcycle shirt or a speed boat shirt with anti-flap placket closure device to reduce flapping of the shirt plackets and shirt collar while the wearer is moving in the open at high speed, such as when piloting a motorcycle, a speed boat, and the like. The device reduces wearer annoyance and distraction and improves driver and rider comfort and safety.

5 Claims, 19 Drawing Sheets

(56) References Cited

U.S. PATENT DOCUMENTS

| | | | | |
|---|---|---|---|---|
| 3,142,843 | A | 8/1964 | Berger | |
| 3,394,437 | A | 7/1968 | Sinclair | |
| 3,418,659 | A | 12/1968 | Brown | |
| 4,074,364 | A | 2/1978 | Lucero | |
| 4,481,682 | A | 11/1984 | Hall | |
| 4,596,569 | A | 6/1986 | Campbell | |
| 4,597,109 | A | 7/1986 | Hironaga | |
| 4,853,979 | A | 8/1989 | Ryder | |
| 4,937,886 | A | 7/1990 | Ellis | |
| 5,033,121 | A | 7/1991 | Larsen | |
| 5,177,813 | A | 1/1993 | Bosack | |
| 5,177,814 | A | 1/1993 | Courtney | |
| 5,276,923 | A | 1/1994 | Cohen | |
| 5,488,738 | A | 2/1996 | Seamans | |
| 5,515,544 | A | 5/1996 | Hosking | |
| 5,682,619 | A | 11/1997 | Griffin | |
| 5,774,899 | A | 7/1998 | Griffin | |
| 6,026,516 | A | 2/2000 | Dacyshyn | |
| 6,167,573 | B1 | 1/2001 | Lewis | |
| 6,959,455 | B2 | 11/2005 | Hall | |
| 7,398,558 | B1 | 7/2008 | Kattenhorn | |
| 7,412,730 | B2 | 8/2008 | Schroeder | |
| 8,065,747 | B2 | 11/2011 | Keeter | |
| 8,209,779 | B2 | 7/2012 | Herman | |
| 8,291,515 | B2 | 10/2012 | Carter | |
| 8,601,615 | B2 | 12/2013 | Isaacson | |
| 8,631,517 | B1 * | 1/2014 | Blakely | A41F 1/004 2/96 |
| 8,769,780 | B1 | 7/2014 | Segel | |
| 8,832,866 | B2 | 9/2014 | Herman | |
| 9,049,895 | B1 | 6/2015 | Wesol | |
| 9,339,071 | B2 | 5/2016 | Herman | |
| 9,538,791 | B2 | 1/2017 | O'Donnell | |
| 9,603,400 | B2 | 3/2017 | Kenney | |
| 9,913,505 | B1 | 3/2018 | Wilson | |
| 9,924,752 | B2 | 3/2018 | Horrey | |
| 10,039,328 | B2 | 8/2018 | English | |
| 10,051,904 | B2 | 8/2018 | Isaacson | |
| 10,165,815 | B1 | 1/2019 | Branker | |
| 10,251,432 | B2 | 4/2019 | Kenney | |
| D847,468 | S | 5/2019 | Genao | |
| 10,842,200 | B2 | 11/2020 | Colon | |
| D913,643 | S | 3/2021 | Tinch | |
| 2003/0135910 | A1 | 7/2003 | Young | |
| 2006/0010559 | A1 | 1/2006 | Hamlet | |
| 2006/0048266 | A1 | 3/2006 | Kim | |
| 2006/0185056 | A1 | 8/2006 | Zwick | |
| 2007/0028368 | A1 * | 2/2007 | Morton | A41F 1/00 2/265 |
| 2010/0235969 | A1 | 9/2010 | Isaacson | |
| 2011/0023342 | A1 * | 2/2011 | Davidson | G09F 3/10 493/405 |
| 2011/0197335 | A1 | 8/2011 | Handy | |
| 2011/0231980 | A1 * | 9/2011 | Chen | A41B 1/10 2/243.1 |
| 2011/0277209 | A1 * | 11/2011 | Behrens | A41B 1/00 2/243.1 |
| 2012/0204308 | A1 * | 8/2012 | Pascuzzi | A41F 1/004 2/69 |
| 2013/0239284 | A1 | 9/2013 | Zamponi | |
| 2013/0247280 | A1 | 9/2013 | Haggard | |
| 2014/0130228 | A1 * | 5/2014 | Horton | A41D 3/02 2/270 |
| 2014/0143985 | A1 * | 5/2014 | Horton | A41F 1/002 24/303 |
| 2014/0304899 | A1 | 10/2014 | Almonte et al. | |
| 2014/0338091 | A1 | 11/2014 | Kenney et al. | |
| 2015/0101109 | A1 | 4/2015 | Herman | |
| 2015/0135399 | A1 * | 5/2015 | O'Donnell | A41B 1/10 2/129 |
| 2015/0230531 | A1 | 8/2015 | Merchen | |
| 2016/0100634 | A1 | 4/2016 | Rogers | |
| 2016/0338415 | A1 | 11/2016 | Aihara | |
| 2017/0095024 | A1 | 4/2017 | Bassin | |
| 2017/0143052 | A1 | 5/2017 | Kenney et al. | |
| 2017/0202288 | A1 * | 7/2017 | O'Donnell | A41B 1/10 |
| 2017/0231287 | A1 * | 8/2017 | O'Donnell | A41F 1/004 2/116 |
| 2017/0238637 | A1 * | 8/2017 | O'Donnell | A41B 1/10 |
| 2017/0325511 | A1 | 11/2017 | Kim | |
| 2018/0213851 | A1 | 8/2018 | O'Donnell | |
| 2019/0254352 | A1 | 8/2019 | Berkowitz | |
| 2019/0261710 | A1 * | 8/2019 | Branan | A41F 1/002 |
| 2020/0253288 | A1 | 8/2020 | O'Donnell | |
| 2022/0338556 | A1 * | 10/2022 | Kriger | A41B 1/10 |

* cited by examiner

SHIRT WITH ANTI-FLAP PLACKET CLOSURE DEVICE AND KIT FOR MAKING THE SAME

CROSS-REFERENCE TO RELATED APPLICATIONS

Priority is hereby claimed to provisional application Ser. No. 63/254,298, filed Oct. 11, 2021, which is incorporated herein by reference.

FIELD OF THE INVENTION

The subject matter disclosed, herein, relates generally to shirts and more particularly to collared full button-down shirts, long sleeved or short sleeved, with two adjacent front panels each having a placket with at least four buttons or four buttonholes, or equivalent closure devices, and even more particularly to shirts intending to be worn by a wearer intending to ride, or ride on, a motorcycle or drive, or ride in, a speed-boat.

BACKGROUND OF THE INVENTION

By definition a motorcycle "rider" is one who rides and operates the motorcycle. It is generally accepted that a rider is not called the driver of the motorcycle, anymore than the rider of a horse is called the driver of the horse. One who rides on a motorcycle is a passenger on the motorcycle. For purposes of the present patent application when referring to a "rider" it means one who is riding or operating a motorcycle. Likewise, one who drives a speed-boat is a "rider" of the boat, along with any passengers.

The term "shirt" is used, herein, as a generic term for an upper body garment, worn by a male or female, (unisex) wearer. A collared button-down shirts, herein, is defined as a shirt having a collar which is attached to a back panel or a yoke connected to a back panel, and to two adjacent front panels and where the front panels are each connected to the back panel, with or without a yoke, at the side seams and wherein the front panels are separated in the mid-front each front panel having a placket from the shirt's hem to the collar-band or in the absence of a collar-band to the shirt's neck hole, wherein the inner or back placket has typically four to seven buttons (or similar closure device components) attached to the front and back layers of the inner placket and an equivalent or corresponding number of buttonholes (or similar closure device components) located on the outer or front placket, wherein the plackets when closed are in the buttoned position.

It was in 1896 that John Brooks of England supposedly invented the button-down collared shirt after witnessing polo players being distracted by their shirt collar flapping in the open-air while in-motion, riding a horse, playing polo. Once the collar flaps were buttoned down, the collar flaps no longer were hitting the polo player in the face and neck and certainly resolved a distraction to playing the game of polo. The Polo shirt, by Brooks Brothers, with the button-down collar was born and became wildly successful as a shirt specifically designed for playing the game of polo and then much later as a fashion statement. So much so, that it became the norm to call a shirt with collar buttons a button-down shirt. Thereafter, some in the apparel industry referred to a full-button down shirt as a full button-up shirt, so as not to be confused with the button-down polo-type shirt. For this patent application the term "full button-up shirt" will be equivalent to and be the same as a full button-down shirt, and vice versa, in that both types, herein, have two adjacent front panels from the shirt's hem to the collar band, each having a placket attached to a front panel with several buttons on the inner, or inside, or back placket and several corresponding buttonholes on the outer, outside, or front placket. The buttoned collar shirts has, in the last few decades, seen a transformation wherein hidden metal and or plastic button-snaps have often replaced the external button so as to conceal the closure device; often the female portion of the button-snap is attached to the inside layer of the collar so as to hide the female portion, or cap, of the button-snap from external view. Motorcycle riders in particular like their collars to have hidden button-snaps as opposed to visible collar button closures. The button-snaps can be fastened and unfastened with only one hand, thus permitting the collars to be locked in place (or unlocked) using only one hand.

Ever since the invention of the motorcycle over one hundred years ago riders of motorcycles have encountered some annoying and distracting problems of their shirt lifting from their upper and mid-body. This happens while in-motion on a motorcycle when the rider is without a jacket or without their shirt hem secured within the rider's pants (and cinched with a belt). The applicant/inventor has filed U.S. patent application Ser. No. 16/943,854 titled, "Shirt with hold-down suspender devices and suspender attachment devices and shirt hold-down suspender devices", to help resolve the problem on the shirt lifting up and away from the wearer's upper body while in motion on a motorcycle when the wearer is wearing his shirt outside of his pants (i.e., untucked).

Another annoying and distracting problem for the rider of a motorcycle or other in-motion activity such as driving a speed-boat, is with the shirt's plackets and collar flapping, while in-motion, striking the wearer's face and or neck, repeatedly, with increasing intensity with increasing speed. This problem is exacerbated when the rider wears his shirt outside his pants. The buttoned-down collar flaps have been extremely useful in holding-down the collar flaps while the wearer is in motion riding a motorcycle or driving a speed-boat. But with the whole of the shirt positioned on the rider's upper body, the collar still slaps about the rider's face and neck, even when the collar flaps are in the buttoned-down position.

In order to fully understand this annoying and distracting problem a short review in aerodynamics is in order. For an airplane to fly or become airborne, it needs two properties: (1) forward thrust and (2) lift. An airplane's engine(s), through propeller-driven combustion engine or jet propulsion, moves the airplane forward creating "thrust"; the first property required. The second property is that of "lift" to make the forward moving airplane fly or become airborne. Lift is created by the wing, or airfoil design, on the airplane. The wings of all airplanes have a leading or forward edge that is thicker overall on the top side of the wing and this dimension reduces in overall thickness of the wing as it goes to the trailing edge of the wing. All wings are nearly flat on the bottom side while the top side of the wing is curved at the leading edge to the trailing edge. This minor difference in design between the top side and bottom side of a wing is what creates lift as the airplane is propelled forward by thrust of the engine(s). The science behind the lift is that lift is created as the wing moves through the air the wing divides the airflow, nearly equally, with half going over the wing and the other half going under the wing. Due to the fact the upper and lower wing surfaces are different in design, as stated, the airflow over and under the wing act differently. Just beyond the curve on the top side of the wing an area of lower pressure is created as the wing moves forward through the air. This low-pressure area over the wing can be thought of as an area of a partial vacuum. To equalize or fill this low-pressure area or partial vacuum area the wing moves upward to fill this partial void, thereby creating upward lift enabling the airplane to become airborne if enough forward trust, or speed, and lift are created.

Likewise, lift is also created as the motorcycle rider moves forward through the air, because the rider's upper body, while in motion, acts much like that of an airfoil or wing on an airplane, as he leans forward. The more the rider leans forward the more lift is created and the more the rider's shirt is lifted upward and away from his shoulders and upper back creating an annoyance and disturbance for the rider, particularly if the rider does not have his shirt tucked into his pants and secured with a belt. This problem is extremely acute for the sport-bike rider who at higher speed leans forward into the wind and with the low-profile windscreen or windshield is forming an airfoil with the windscreen being the leading edge and the rider's helmet and upper shoulders form the top of the airfoil with the rider's sloping back forming the top and rear of the airfoil. So the sport-rider, at speed, find his shirt lifting and flapping in the open-air.

While the rider is in motion, the shirt's plackets and shirt collar start lifting and flapping and striking the rider repeatedly in the face and/or neck, with increasing annoyance and distraction with increasing speed through the open air. The effect is more intense when the shirt collar-band button is not buttoned around the rider's neck (which allows substantial airflow between the rider's body and the inside of the shirt).

Over the last few decades, as clothing styles have changed, men have moved away from tucking their shirts into their pants and securing their tucked-in shirt with a belt. The trend is such that there is a clothing company specifically named "UNTUCKit" (110 Greene Street, New York, NY) that makes and markets shirts specifically designed to be worn untucked. One factor for this change may be that in the last few decades the obesity rate has increased among people in general, including riders of motorcycles. With that there has been an increased trend of riders to buy shirts designed specifically to be worn outside rider's pants. In the past most shirts have included shirttails with a curved extended hem line allowing greater ease to tuck in the shirt into the wearer's pants. Now in recent years many shirts are designed to be worn outside the wearer's pants. As a result the shirttails have been eliminated entirely—the shirt hem is all one length.

Motorcycle riders have always had to contend with wearing shirts made for the mass-market; customized shirts tailored or designed for the motorcycle rider have been non-existent.

The problems noted above have been further exacerbated in recent years by shirt manufacturers switching from heavy-weight cotton fabrics to extremely lightweight polyester fabrics. The lighter weight fabrics have a far greater tendency to lift and flap when the rider is moving at high speed on a motorcycle or in a speed-boat.

Many decades ago the leading European shirt manufactures established a standard pattern for button and buttonhole location and spacing for full button-down shirts that American and Chinese shirt manufacturers have since adapted. The industry-standard button location and spacing pattern has not changed in many decades. The industry-standard pattern for a full button-down shirt with a collar-band is one button and one buttonhole located on the collar-band with several buttons attached to the inside placket and several corresponding buttonholes attached to the outside placket. Most collared shirts have a collar-band that is approximately 1 inch in vertical dimension with a button or buttonhole centered vertically on the collar-band. The collar-band is connected to the back panel or yoke panel, the front panels, and the plackets of the shirt. The upper end of plackets end at the bottom of the collar-band or, in the absence of the collar-band, the plackets terminate at the neck-hole of the shirt. Of the two plackets connected to the two front panels, the back placket (also known as the "rear" or "inner" placket) contains the buttons spaced apart with the first placket button being spaced approximately 2⅞ inches to 3½ inches below the collar-band button, according to industry standards set many decades ago. The spacing between the first placket button and the second placket button is invariably between 3⅛ inches to 3½ inches. This spacing is repeated keeping the spacing equal between subsequent lower buttons on the inner placket. The button holes on the outer placket corresponding in spacing to the buttons on the inner placket. Typically, full button-down shirts will have from 5 to 7 buttons on the inner placket and from 5 to 7 corresponding buttonholes on the outer placket.

So currently, as in the past, the motorcycle rider or the driver of a speed-boat to attempt to overcome the annoying and distracting problem of wearer's collared button-down shirt repeatedly slapping the wearer in the neck and face has been, in addition, to fastening all the buttons, or closure devices on the plackets, is to fasten the collar-band button into the collar-band buttonhole. As previously stated, in recent decades the obesity rate has increased to the point that many motorcycle riders find it difficult to fasten the collar-band button to the collar-band buttonhole. The rider or wearer certainly can overcome this problem by going to a larger size shirt, but therein lies a further problem. By doing so, the larger shirt flaps in the open air even more. Riders generally like to wear tight fitting shirts to minimize the overall flapping of the shirt. By doing so most riders find it is very difficult to fasten the collar-band button to the collar-band buttonhole. The only option, then, to minimize the collar flapping and placket flapping, while in motion, is to have the top or first placket button, buttoned. However, the first placket button and buttonhole is too low to prevent the collar and placket from lifting and slapping the rider in the face while in motion on a motorcycle or in a speed-boat. Inherently, then, there is a problem here with all conventionally manufactured, off-the-shelf, collared button-down shirts. The industry standard on the location of the first placket button and buttonhole location is too far below the collar band button and buttonhole to prevent the problems stated above.

BRIEF SUMMARY OF INVENTION

Disclosed is a method of manufacturing or modifying a motorcycle shirt or a speed-boat shirt, as well as the shirt so made, to have at least one anti-flap placket closure device, located and attached, between ¼ inch and 2¼ inches below the collar-band, for those shirts that have a collar-band, or between 1 inch and 3 inches below the neck-hole, for those shirt that do not have a collar-band.

A shirt-maker or modifier who currently supplies motorcycle or speed-boat retailers with apparel, namely shirts, where the modifier embellishes a shirt with motorcycle or speed-boat related artwork by means of heat-transfer, hot-stamp, silk-screening, heat-activated adhesive embroidered patches, and so forth, are in a position to quickly and easily, at low cost, add the anti-flap placket closure disclosed herein to shirts. The modification adds significant appeal to the purchaser of the shirt because of the added safety and comfort the shirt provides to a motorcycle rider or speed-boat driver.

The shirt maker or modifier can take a standard, off-the-shelf, collared button-down shirt and modify the shirt to have the anti-flap placket closure disclosed herein. The closure may be a male/female button-snap closure, or a positive/negative magnet closure, or a plastic or metal hook-and-loop closure, or a micro hook-and-loop closure (such as a Velcro®-brand closure), where the wearer can with one hand fasten the mating halves of the anti-flap closure device together. It is easier to fasten these devices with one hand than it is to attempt to fasten a button through a buttonhole with one hand, while in motion.

Shirt manufactures looking to provide shirts to "high speed pursuits" market will consider the shirt disclosed herein to promote additional sales due to this improved product for this specific industry. With the shirt disclosed herein, there is no need for the collar-band button and buttonhole, which can be eliminated for a cost savings.

DETAILED DESCRIPTION OF THE INVENTION

Figure 1:
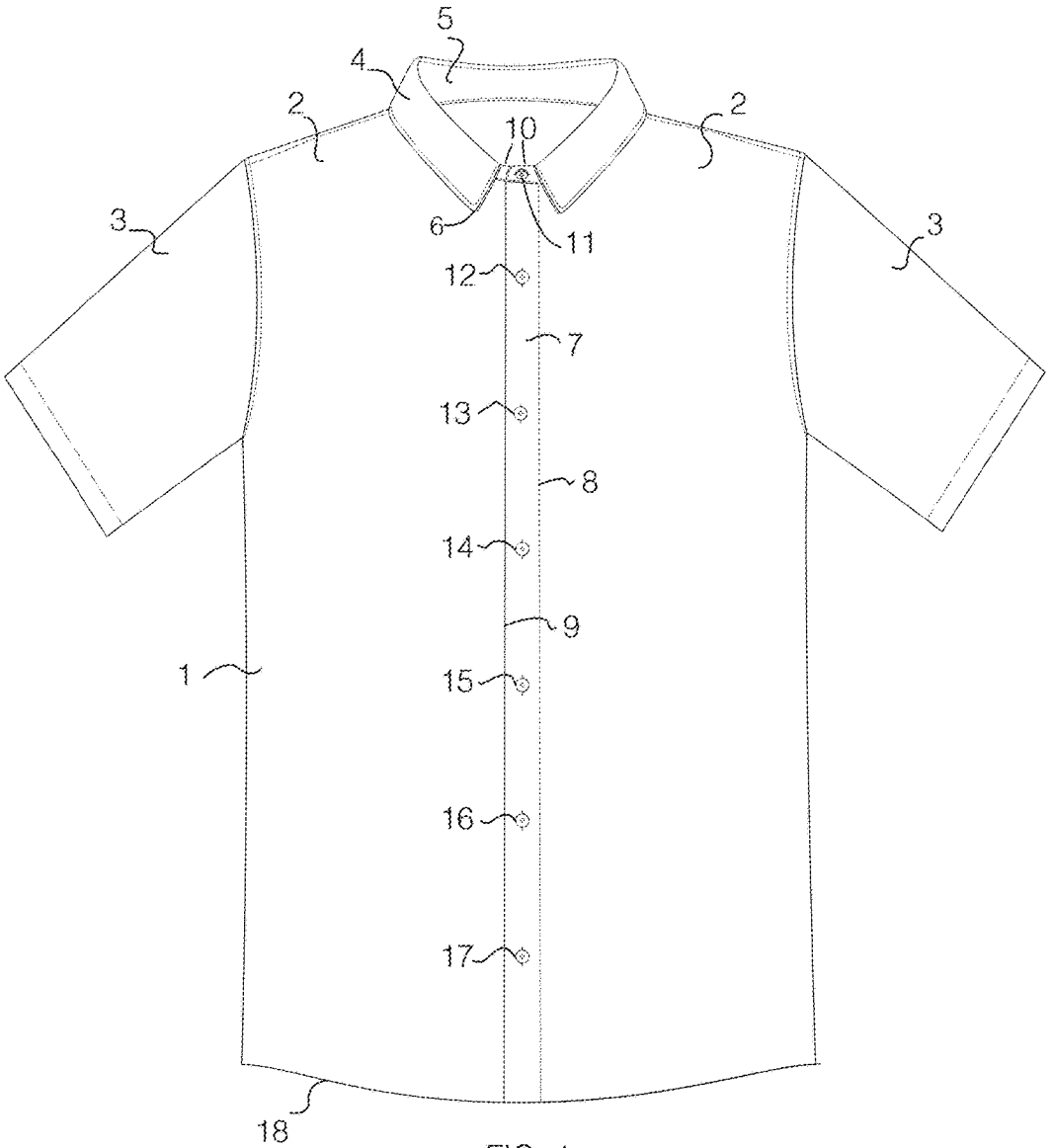
FIG. 1 depicts a front view of a conventional unisex button-down or button-up collared shirt having two front panels with plackets in the closed or buttoned position (prior art).

Shown in FIG. 1 is "off-the-shelf" mass-market type collared button-down shirt 1 with two front panels 2 and at least two sleeve panels 3 (understanding that the sleeve panels maybe short or long), with collar 4, having and inside collar 5, with two collar flaps 6, and a front, or outer, or outside placket 7 with a inner placket edge 8 (understanding that not all shirts of this type have an inner placket edge on the outside of the placket that is stitched), but do have a inner placket edge 8 on the inside of the shirt 1, and an outside placket edge 9, and a collar-band 10 that goes around the circumference of the collar 4, and is shown in the closed position by the collar-band button 11 being fastened, and buttons 12, 13, 14, 15, 16, 17 are shown going vertically through the outer placket 7 buttonholes. The placket buttons 12, 13, 14, 15, 16, 17 are considered herein to be separate from the collar-band button 10 and the industry standard in the shirt making business calls for the spacing between the collar-band button 11 and the first placket button 12 to be slightly less than the spacing between the first placket button 12 and the second placket button 13. The spacing on all lower buttons, by industry standard, is the same as between the spacing between the first placket button 12 and the second placket button 13. The shirt bottom terminates at the shirt hem 18.

Figure 2:
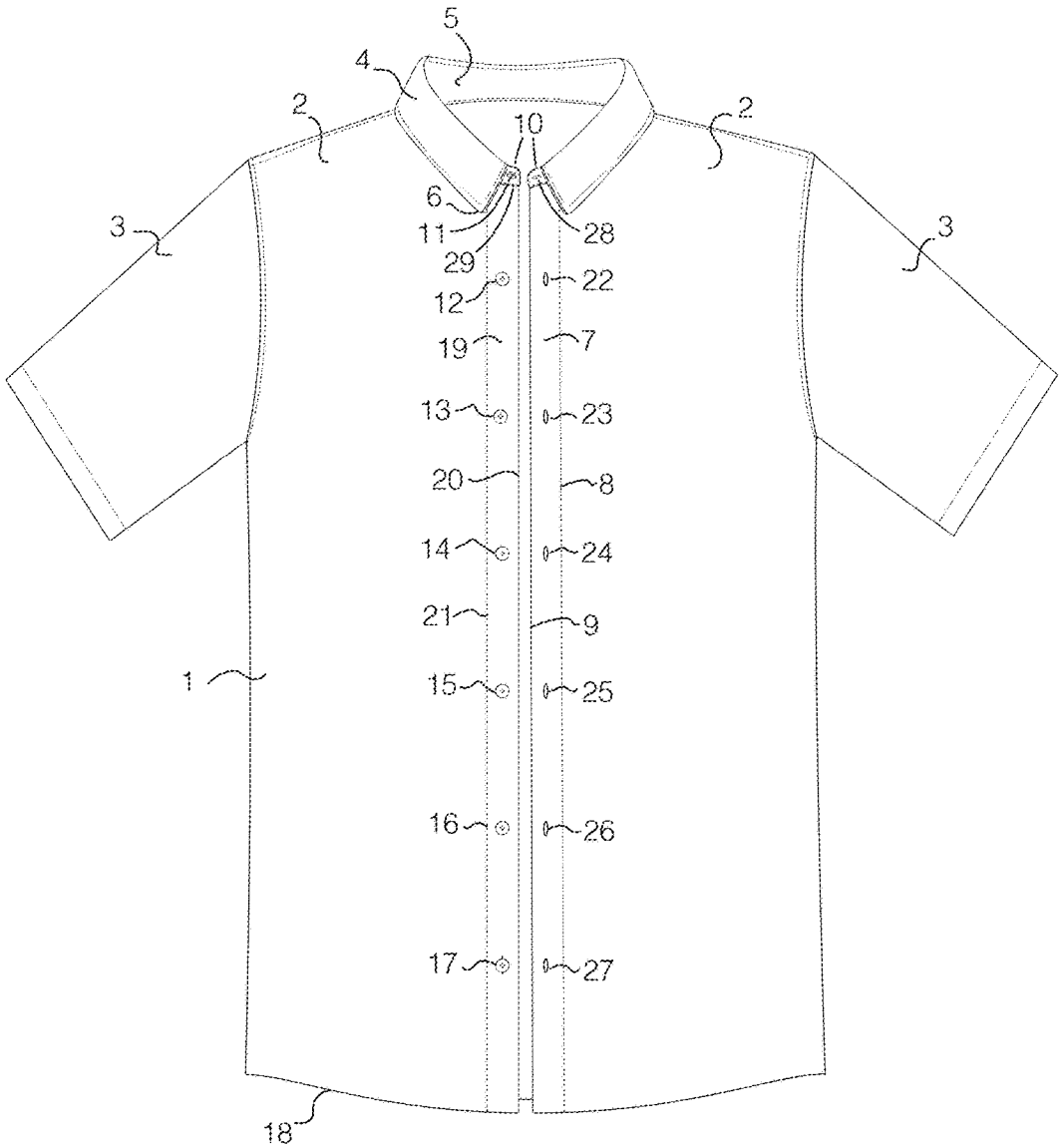
FIG. 2 depicts a front view of a conventional unisex button-down or button-up collared shirt having two front panel with plackets in the opened or unbuttoned position (prior art).

Shown in FIG. 2 is shirt 1 where there is inner, or inside, or back placket 19 having an outer placket edge 20 and an inner placket edge 21, that may or may not be stitched, and the outer or front placket has buttonholes 22, 23, 24, 25, 26, 27 with a collar-band buttonhole 28 and a with the collar-band lower edge 29. The plackets 7, 19 terminate at the upper end at the bottom of the collar-band 29. It is understood that collared buttoned shirt may vary in the number of buttons and buttonholes they have on the plackets when considering shirts are made in various sizes.

Figure 3:
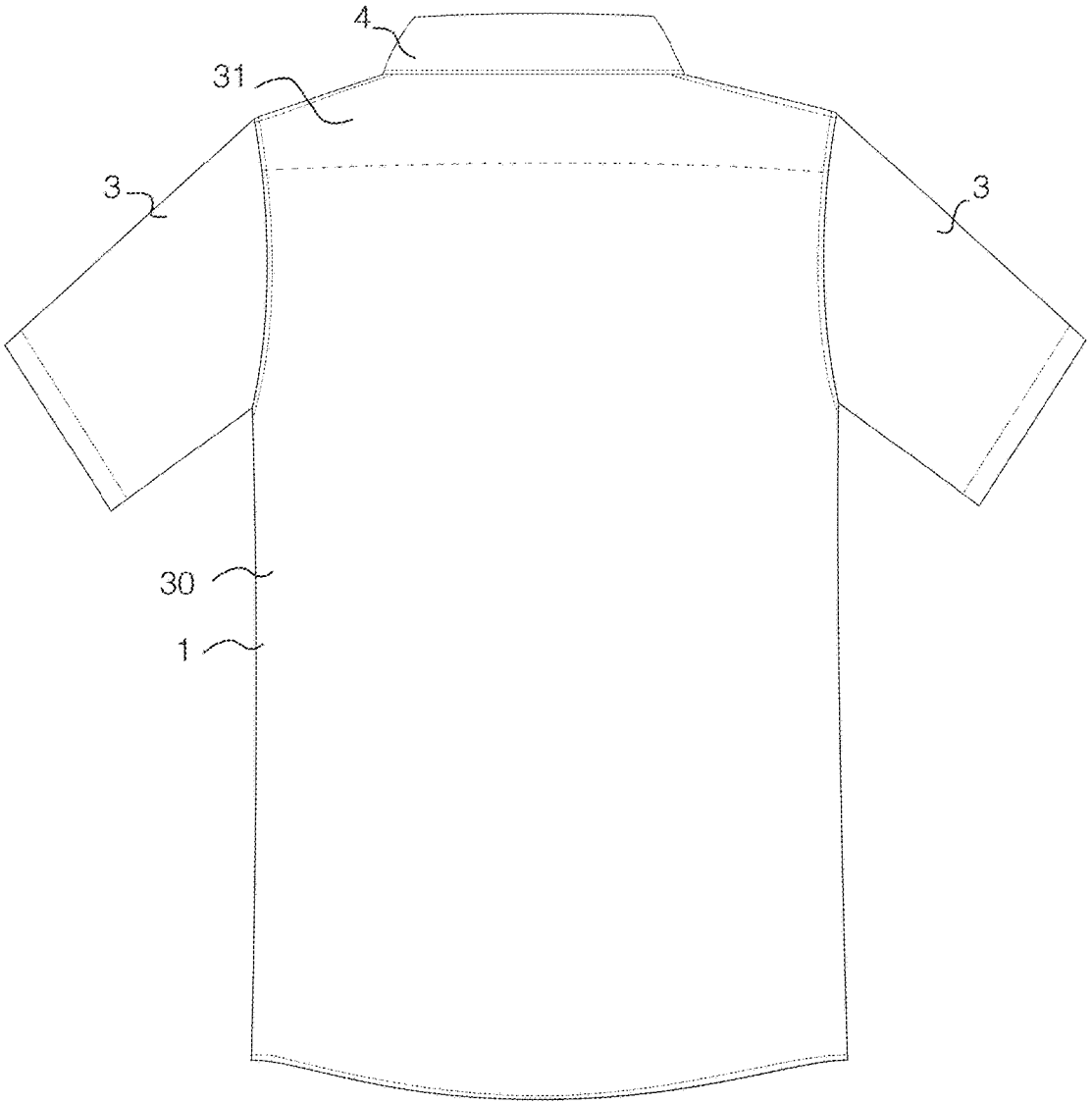
FIG. 3 depicts a rear view of the shirt shown in FIG. 1 (prior art).

Shown in FIG. 3 is the back 30 of the shirt 1 where some shirts backs 30 are made with a yoke 31, and for this patent application said shirt back 30 can have a yoke 31 or not have a yoke 31 and said yoke herein is considered to be part of said back panel 30.

Figure 4:
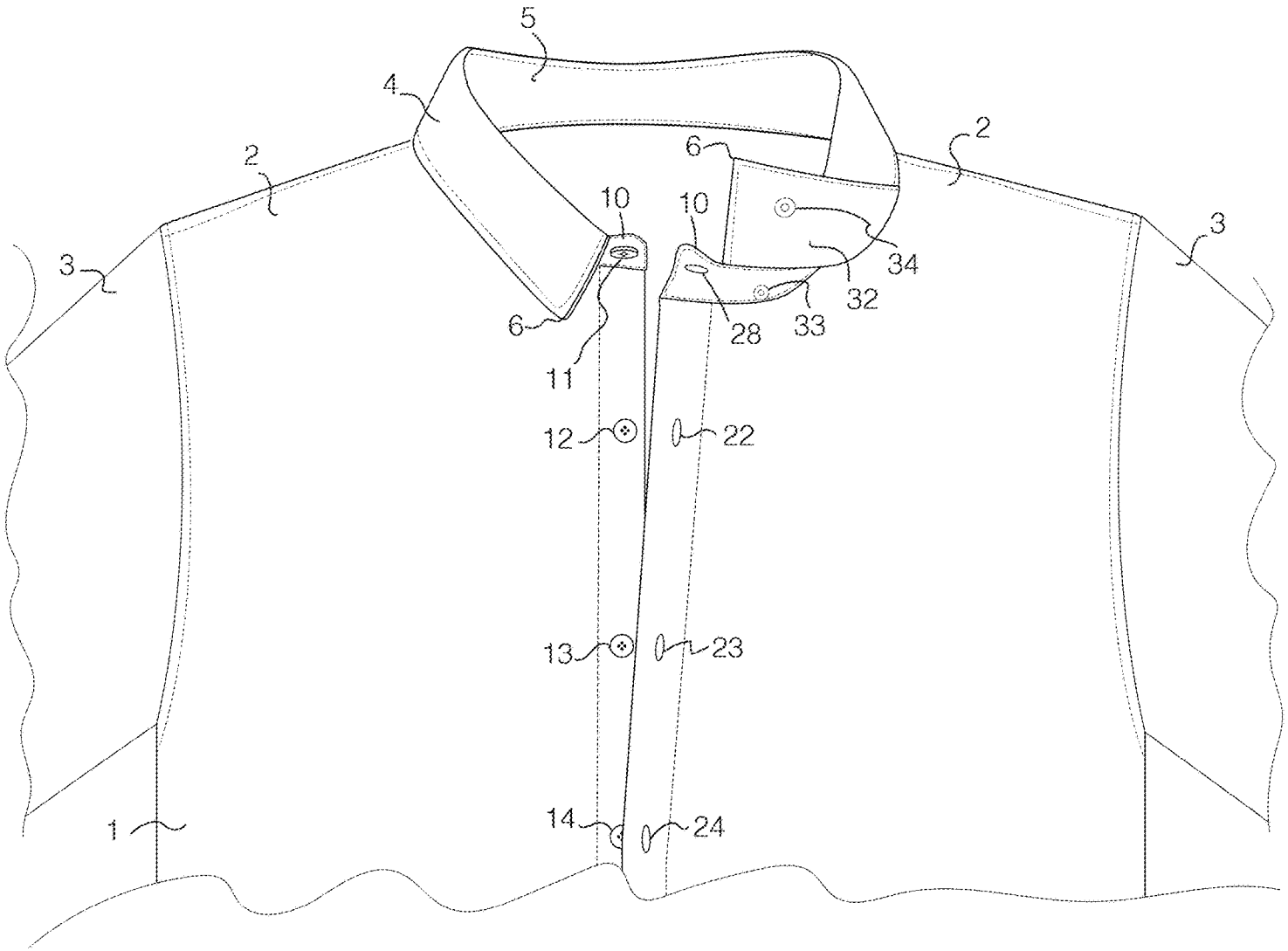
FIG. 4 depicts a close-up front view of the shirt shown in FIG. 1. with the shirt partially buttoned and with one collar flap turned up showing the collar button-snap components (prior-art).

Shown in FIG. 4 is shirt 1 with the collar 4 that has two collar flaps 6 where one collar flap 6 is turn up showing the collar underneath 32 where collar button-snap component 33 and its mating collar band-snap component 34 when the collar 4 button-snap components 33, 34 are snapped together it forms closure (prior-art) that is considered herein as anti-flap closure device (prior-art).

Figure 5:
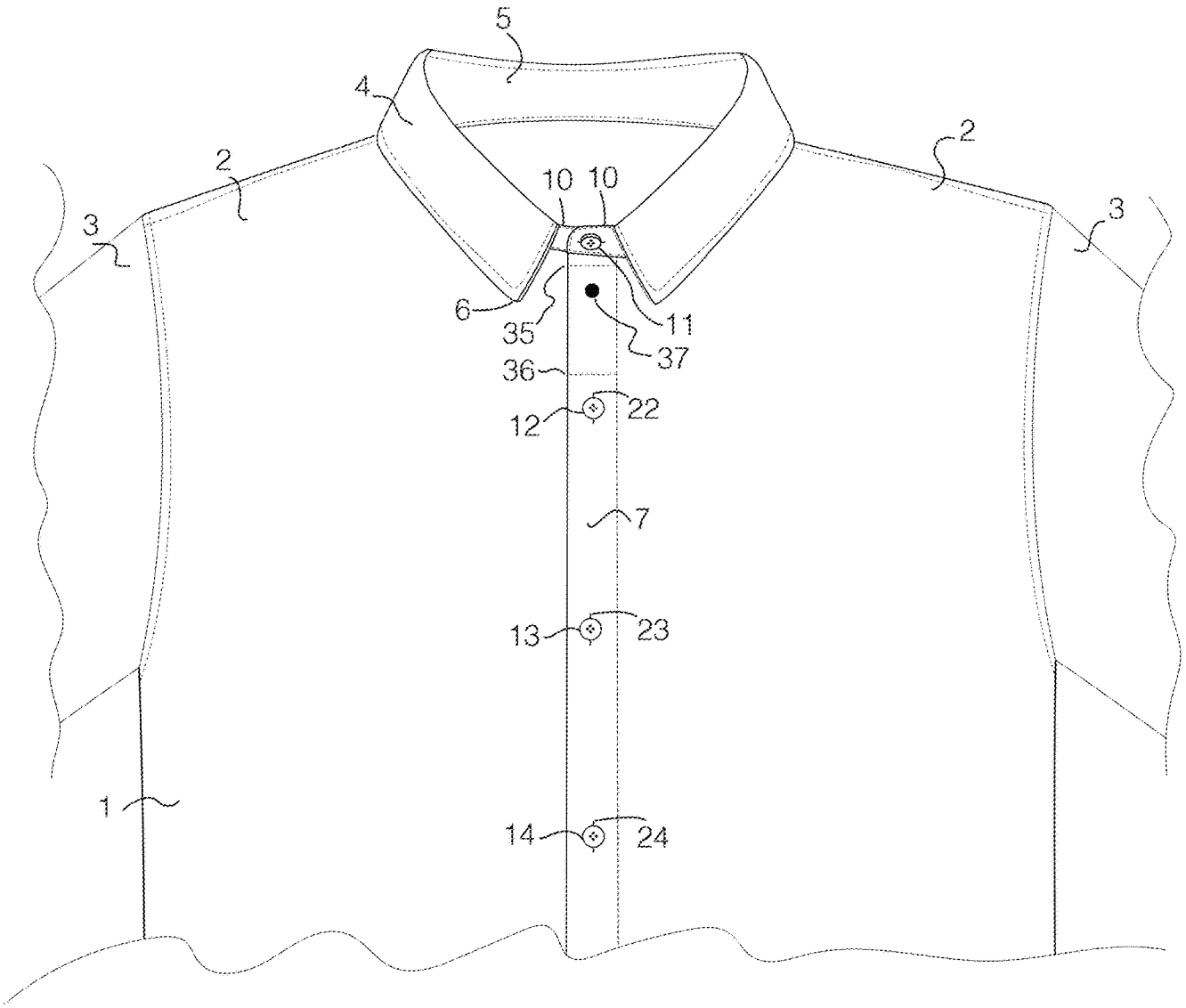
FIG. 5 depicts a close-up front view of inventive motorcycle shirt with an anti-flap placket closure device (in the closed position) below the collar collar-band, but above the first placket button and an upper dashed-line representing the ¼ inch mark below the collar-band and a lower dashed-line representing the 2 inch mark below the collar-band, wherein the anti-flap placket closure must reside between the ¼ inch mark and the 2 inch mark according to the claims stated herein.

Shown in FIG. 5 is shirt 1 showing outer placket 7 fasten to the inner placket 19 (not shown) with buttons 12, 13, 14 protruding through buttonholes 22, 23, 24, and where a upper dashed line 35 is shown only to represent the upper boundary where the center-point of anti-flap placket closure device can be located within the Claims of this patent application, which is ¼ inch below the bottom of the placket 29 and the lower dashed line 36 represents the lower boundary where the claimed center-point of the anti-flap placket closure device can be located or attached to said placket, which is 2 inches below the bottom of the collar-band 29. The centerline of the anti-flap placket closure device is to be positioned and attached between the dashed line area 35, 36. to be effective as an anti-flap placket closure device in the present invention. The dashed lines 35, 36 are shown herein only for purposes of illustration and are not on said shirt.

Figure 6:
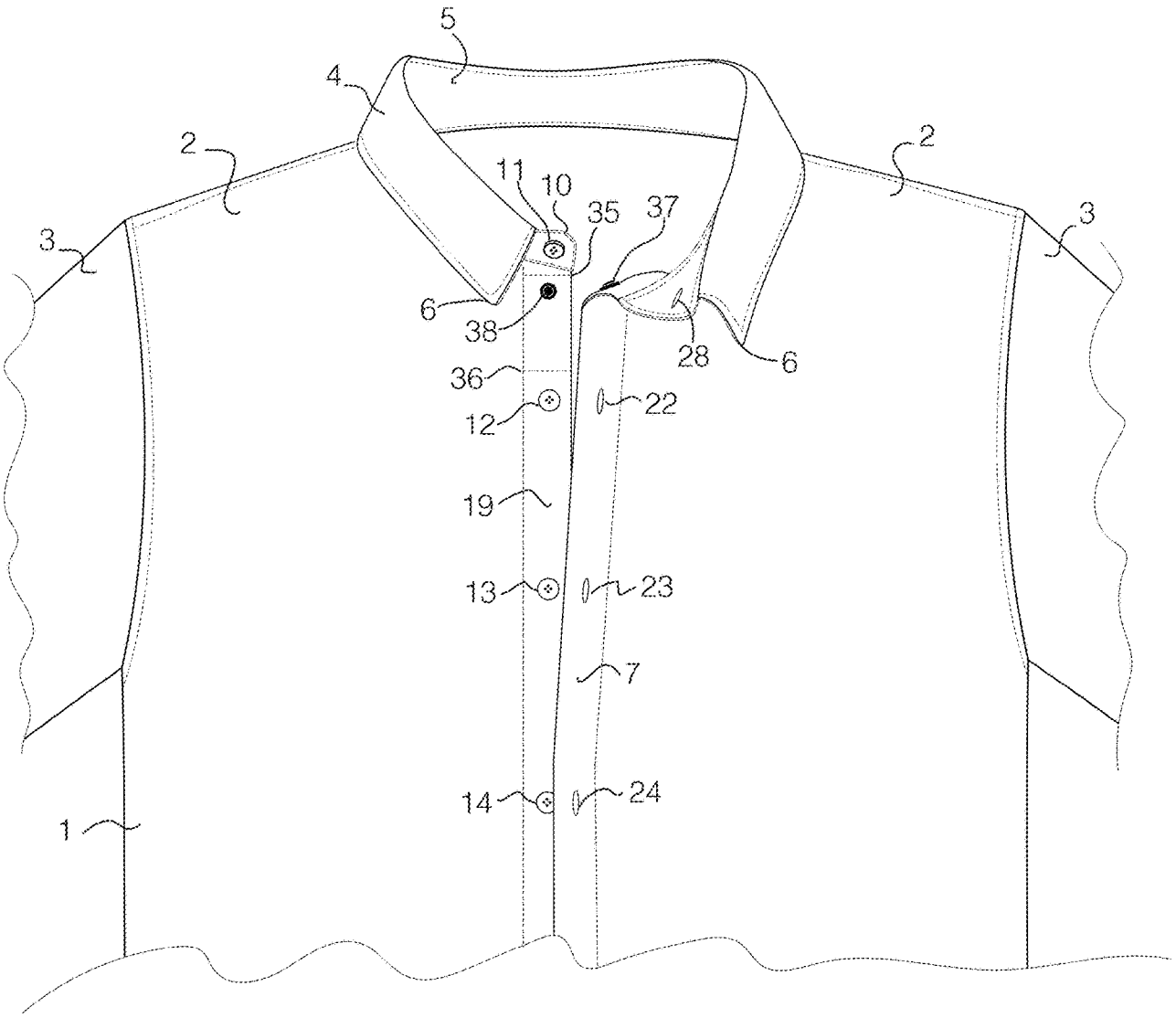
FIG. 6 depicts a close-up front view of inventive motorcycle shirt with an anti-flap placket closure device in the opened, or unsnapped, position showing the plackets in the unbuttoned position.

Shown in FIG. 6. is shirt 1 in the open position wherein both plackets 7, 19 are shown and where the back side of anti-flap placket closure device 37 (in this example a button-snap) is shown and the mating portion of said anti-flap placket closure 38 is shown on the inner placket 19.

Figure 7:
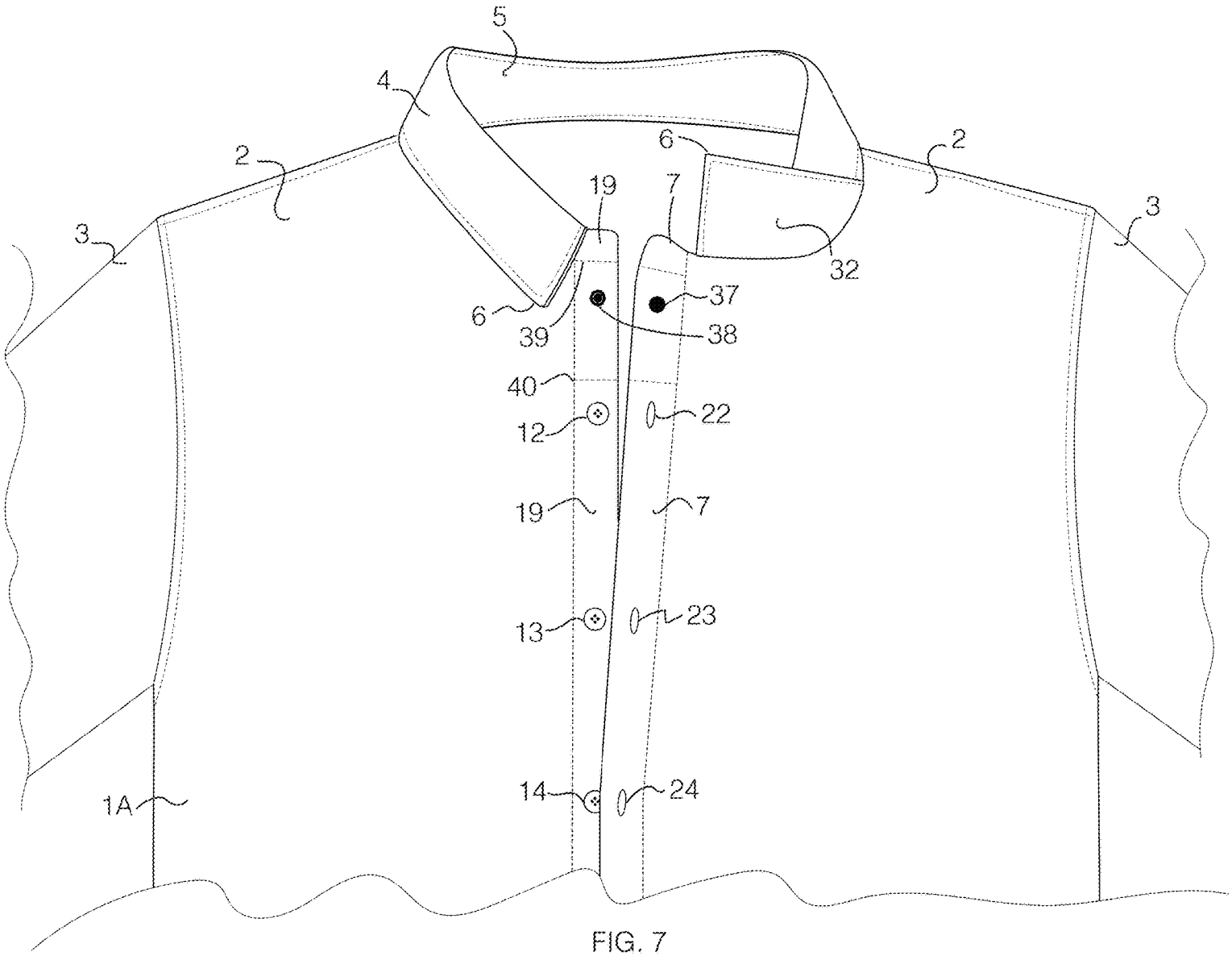
FIG. 7. depicts a close-up front view of the inventive shirt where the shirt does not have a collar-band, or a collar with button and buttonhole, where there are drawn dashed lines that represents the approximate 1 inch mark on the upper dashed line and 3 inch mark on the lower dashed line wherein the present invention calls for in the claims herein, where the anti-flap placket closure must be located and attached within this specified area.

Shown in FIG. 7 is shirt 1A which differs from shirt 1 in that shirt 1A does not have a collar-band and therefore plackets 7, 19 terminate at the neck-hole of the shirt or the upper end of plackets 7, 19. Accordingly, the Claim in the current patent application the anti-flap closure device must be attached to the plackets between 1 inch below the neck-hole, absent the collar-band, and above 3 inches below the neck-hole where these dimensions are measured from the centerline of said placket anti-flap closure device to the neck-hole of shirt 1A.

Figure 8:
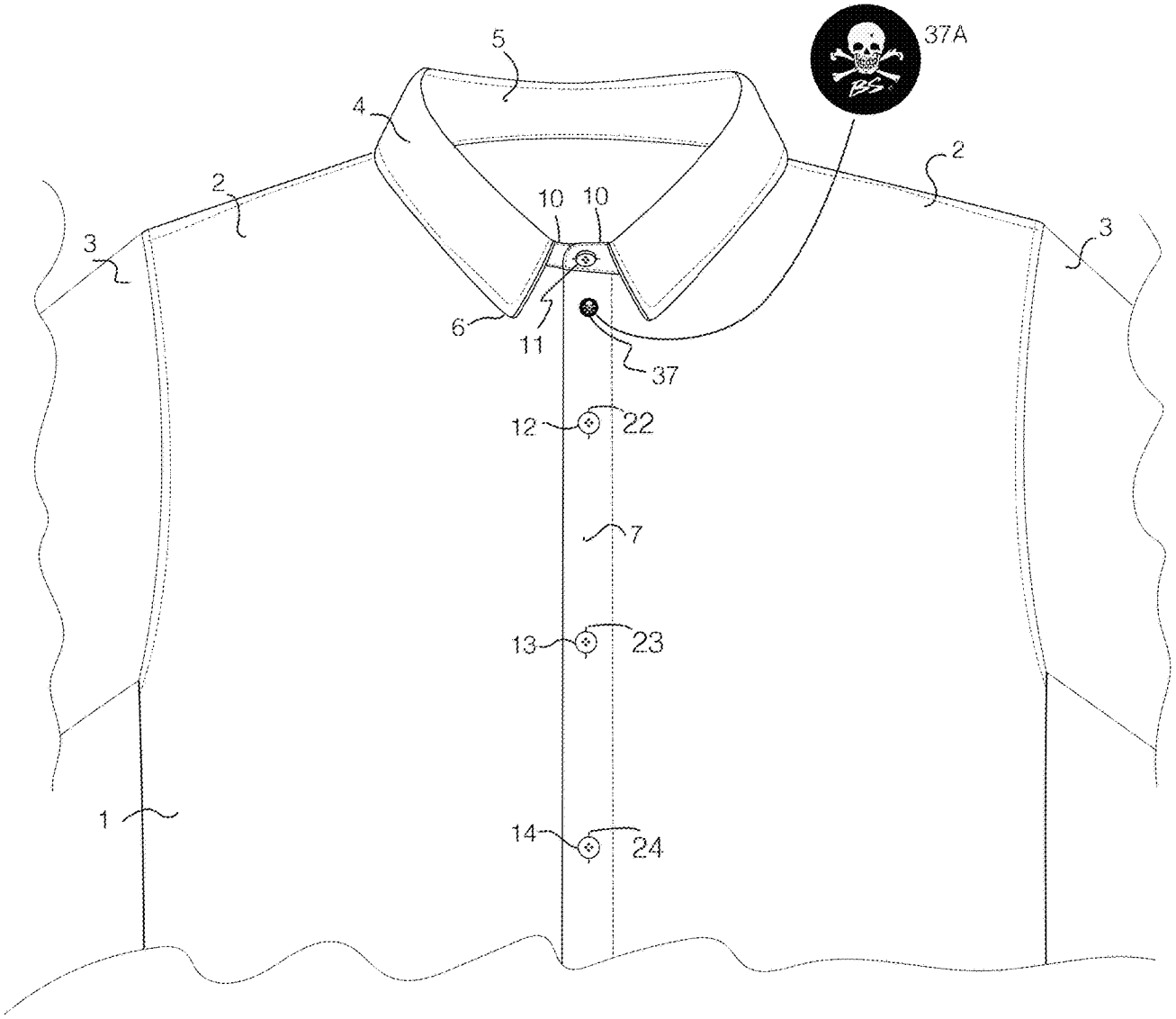
FIG. 8 depicts the inventive shirt with a BS (BikerSnap) logo on the anti-flap closure device in the closed position.

Shown in FIG. 8 is shirt 1 showing anti-flap placket closure device 37, (herein this example being metal or plastic button-snap) with a BS logo which stands for BikerShirt or BikerSnap and is well differentiate from the other placket closure devices.

Figure 9:
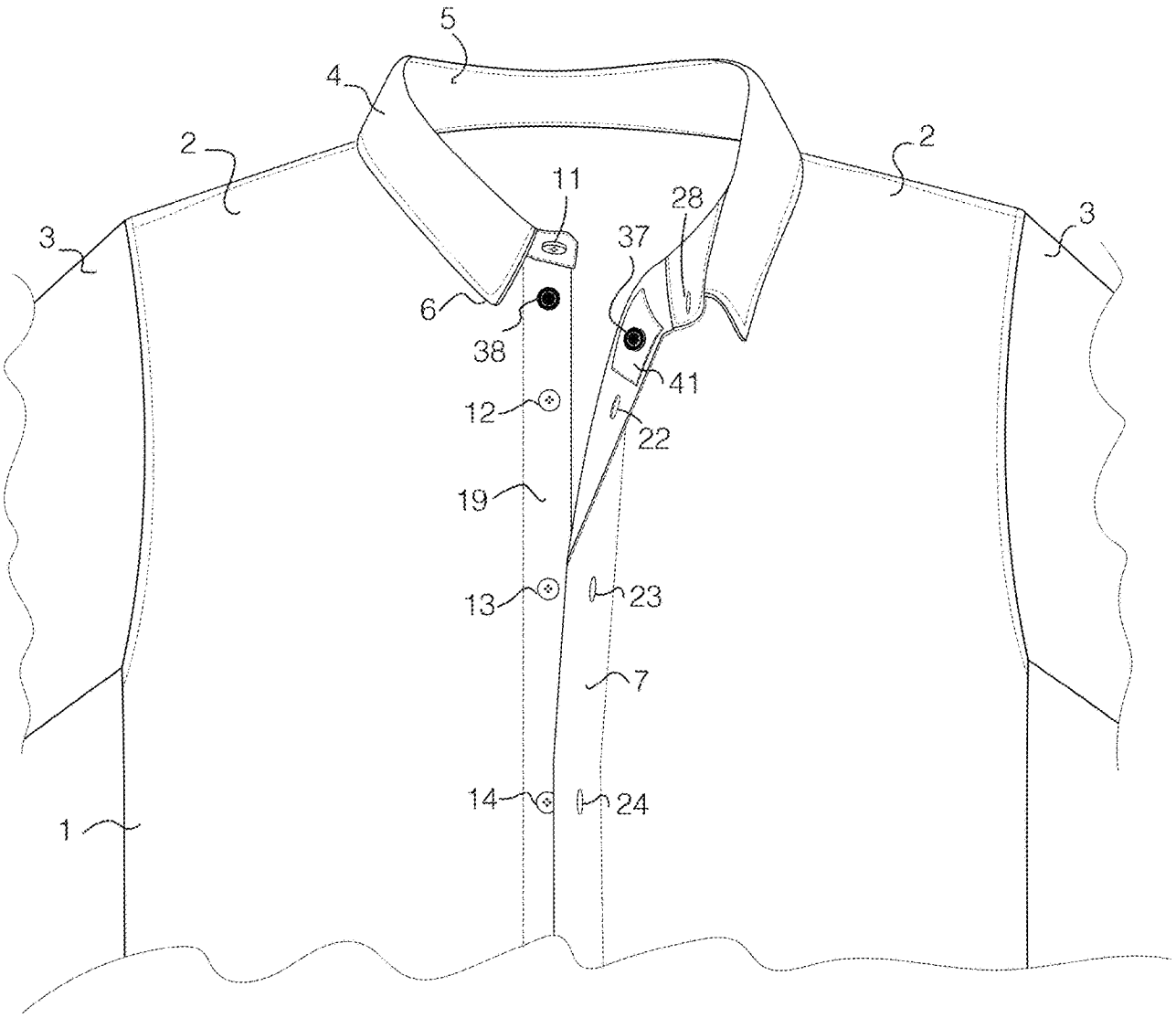
FIG. 9 depicts the inventive shirt with the mating anti-flap placket closure unattached (or in open position) with outer placket having a fly-placket or a hidden secondary placket piece wherein the outer anti-flap placket closure component is attached and hidden from frontal view by the fly-placket or the hidden secondary placket piece that is attached to the back of the outer or front placket. Herein the anti-flap closure device is shown as a button-snap or a snap-button.

Shown in FIG. 9 is shirt 1 showing plackets 7, 19 in the unbuttoned position with anti-flap placket closure device components 37, 38 (herein shown as metal or plastic button-snaps, understanding that this closure device can be instead a metal and or plastic hook and loop, a Velcro hook and loop, a male/female magnet, a positive/negative magnet, or a button and buttonhole) where the one-half of the anti-flap placket closure device 37 is attached to an addition placket piece 41 or fly-placket 41 that is attached to the back of the front placket and is therefore hidden from frontal view, and the mating closure half 38 is attached to the back or inner placket.

Figure 10:
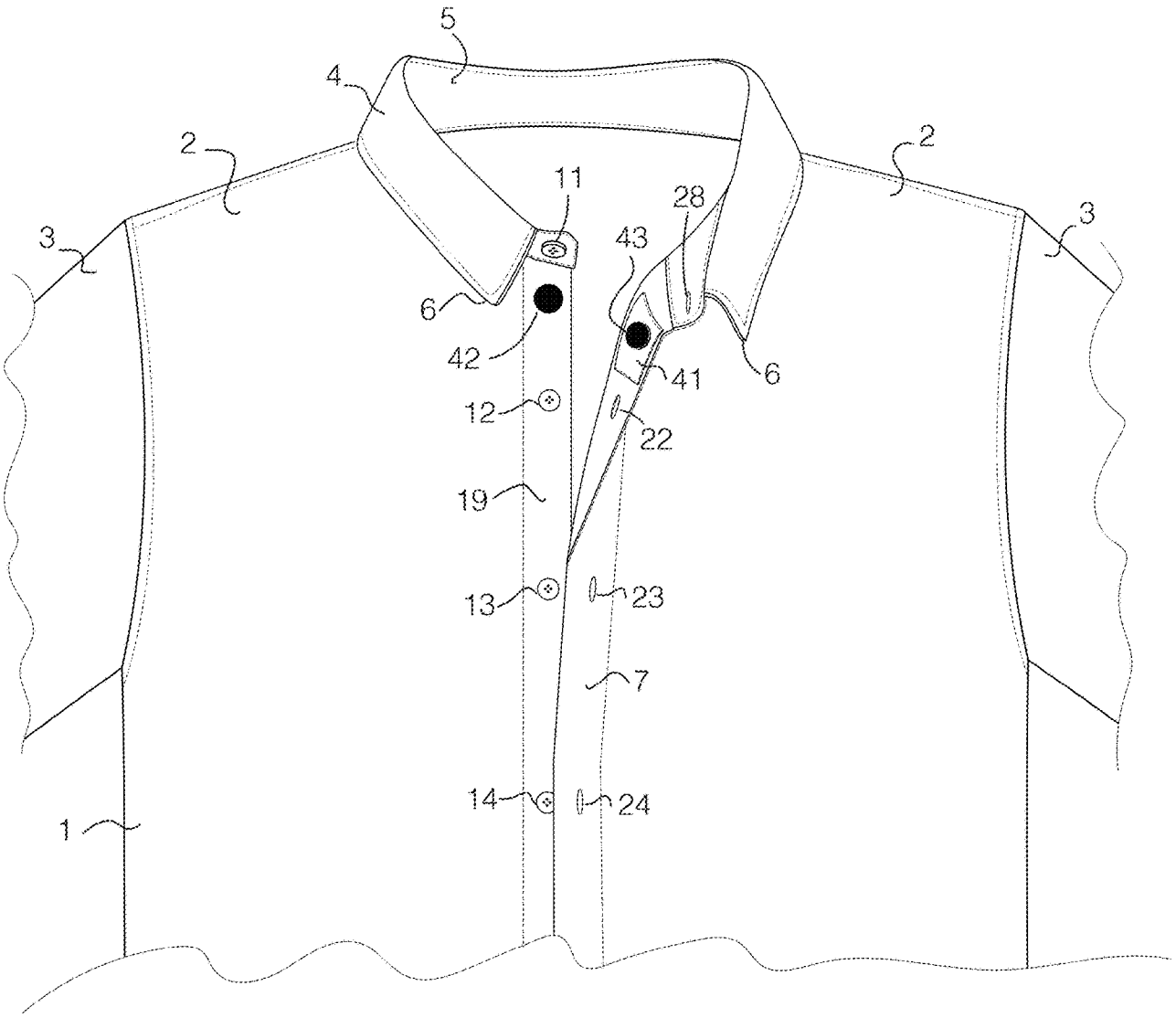
FIG. 10 depicts the inventive shirt with the mating anti-flap placket closure unattached (or in open position), which is in this example a positive and negative magnet component with outer placket or primary placket having a fly-placket or a hidden placket piece, or secondary placket piece, wherein the outer anti-flap placket closure component (magnet piece) is attached and hidden from frontal view by the fly-placket or the hidden secondary placket piece that is attached to the back of the outer or front placket. Herein the anti-flap closure device is shown as a button snap or a snap button as an example.

Shown in FIG. 10 is shirt 1 which is identical to shirt 1 shown in FIG. 9 with the exception that the anti-flap closure device is a male/female magnet 42, 43 or positive/negative magnet closure device 42, 43 wherein the outer or front placket 7 has hidden said magnet closure 43 by means of fly-placket 41 or a secondary placket layer 41 or pocket 41 where the magnet has been attached to or is within said fly-placket 41 or pocket 41 means of adhesive or insertion and stitching.

Figure 11:
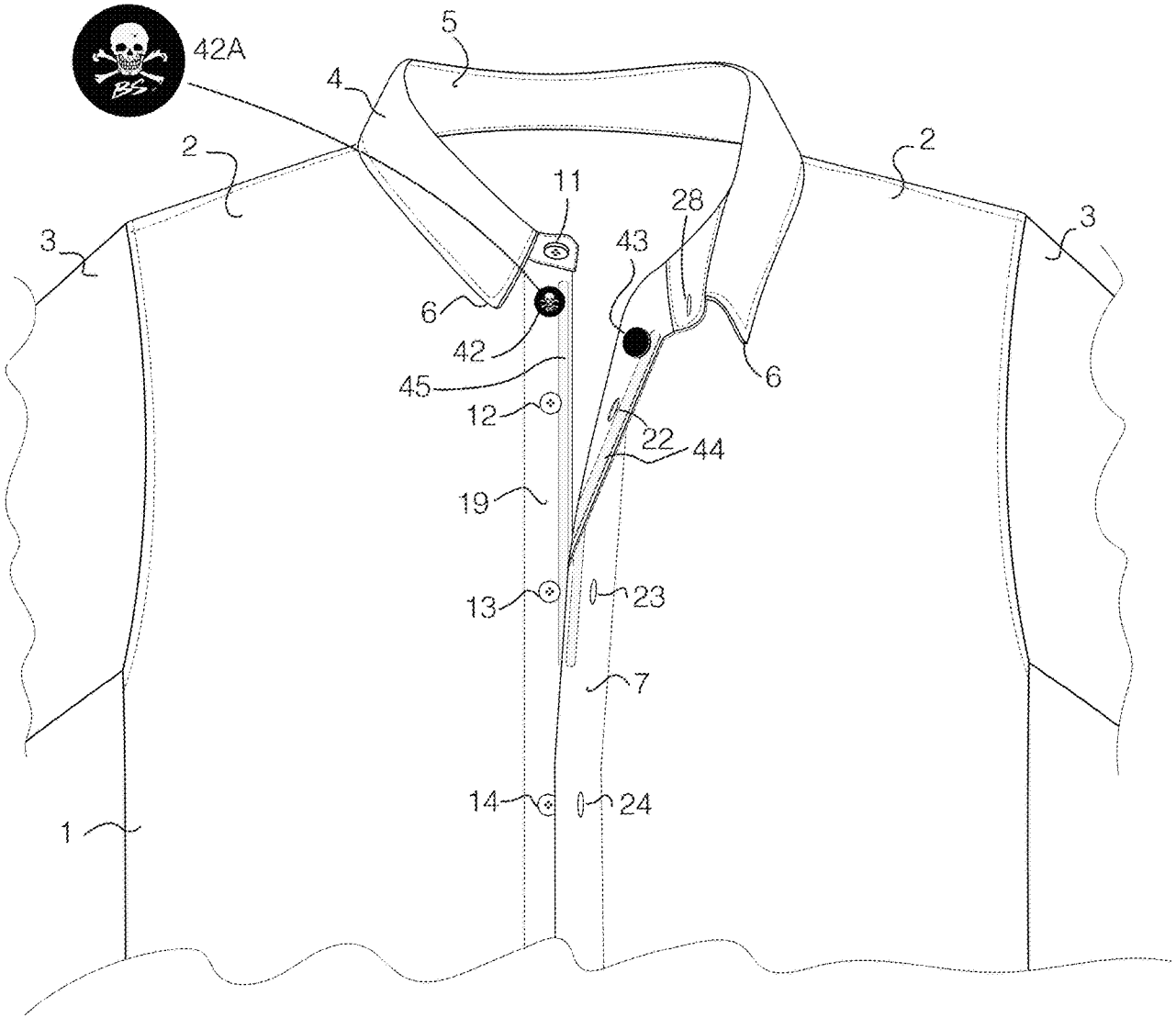
FIG. 11 depicts the inventive shirt with the plackets unbuttoned or in the open position showing the anti-flap closure device, in this example as a positive and negative magnet closure device with a BS (BikerSnap) logo and showing a placket stay in the outer placket and a placket stay in the inner placket to prevent the plackets from experiencing placket droop, especially due to the extra weight caused by the addition of the anti-flap closure device, being in this example, a magnet.

Shown in FIG. 11 is shirt 1 with a anti-flap placket closure device, herein as example a magnet 42, with pad-printed logo design 42A, with plastic placket stay 44 within front placket 7 and plastic placket stay 45 within back placket 19 which help overcome placket droop due to the additional weight of said magnet closure device 43, 44.

Figure 12:
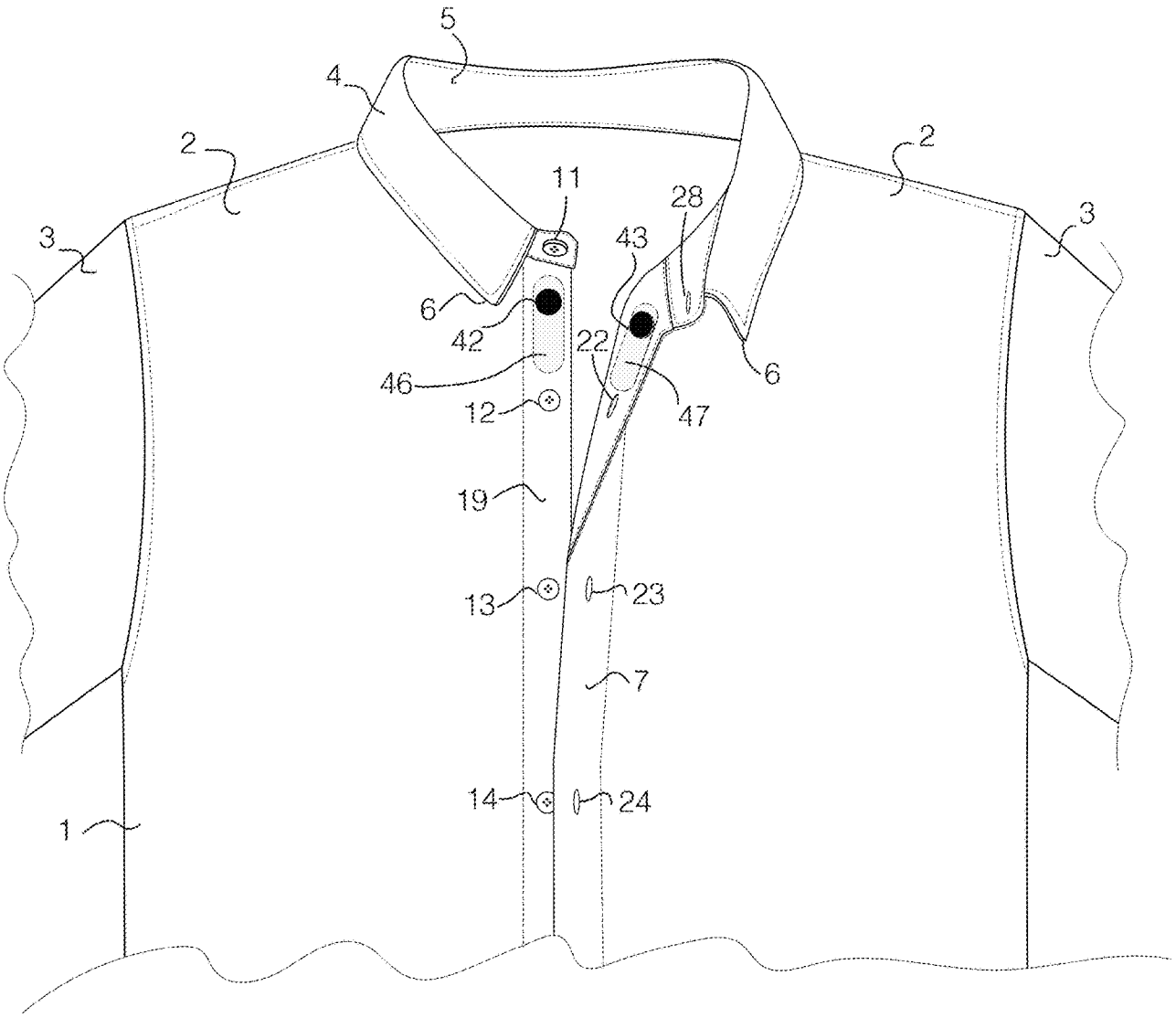
FIG. 12 depicts the inventive shirt with the plackets unbuttoned position showing a magnetic anti-flap closure device in the open position attached to a stiffener device that is attached to back side of the front placket and the other magnet component is attached to the inside of the back placket in this example.

Shown in FIG. 12 is shirt 1 with a anti-flap placket closure device 42/46, 43/47 in the example a magnet closure that is adhered to a placket stiffener that can be inserted and attached to the inside of each placket 7, 19 or can be attached to the outside of said plackets 7, 19 by heat-activated thermoplastic adhesive. The length and width and design of components 46, 47 can vary.

Figure 13A:
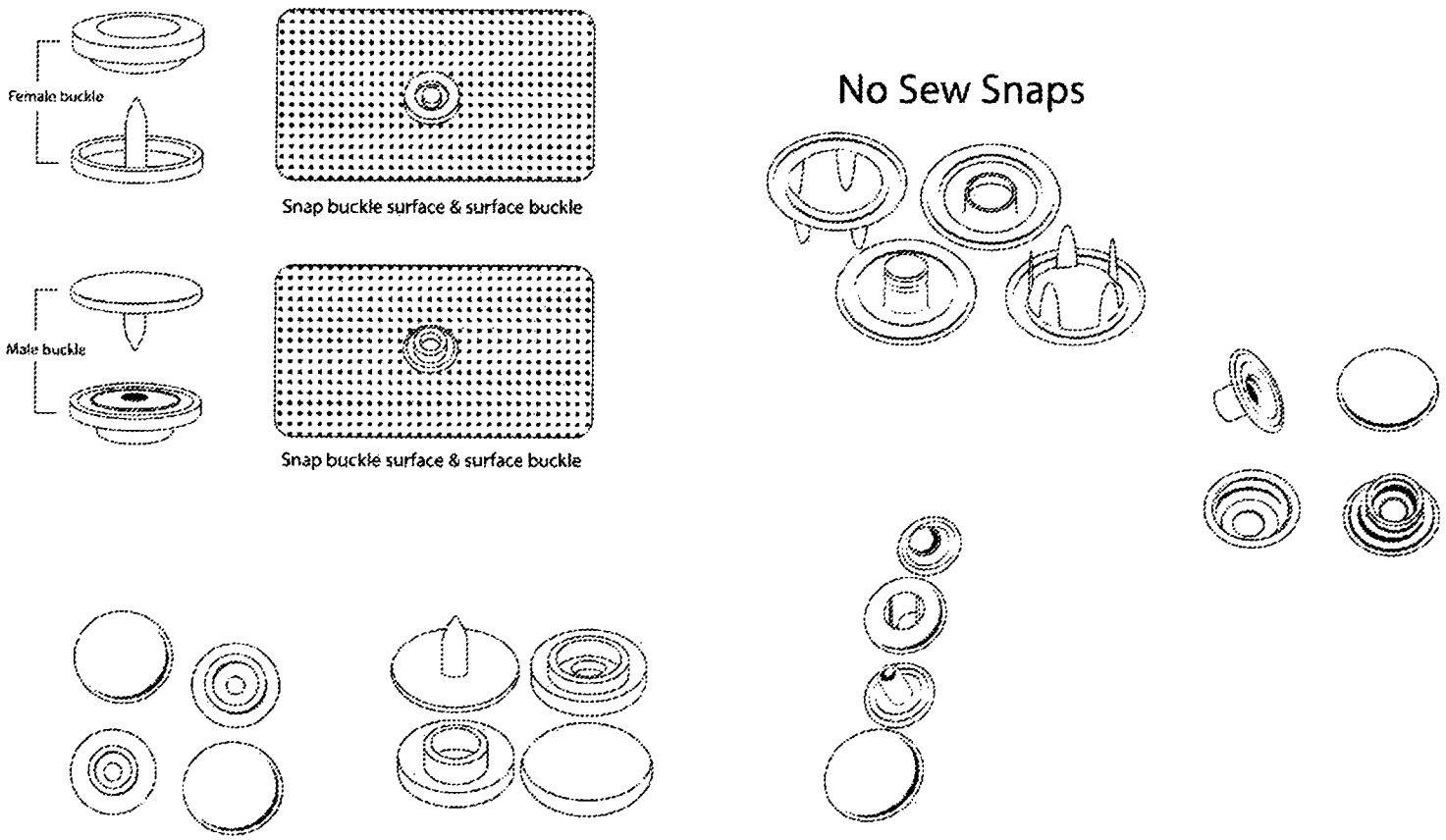
FIGS. 13A, 13B, 13C, 13D, 13E, 13F and 13G depict exemplary closures that can be used in the present device, including snaps and buckles of various configurations (FIG. 13A), macro hook-and-loop closures (FIG. 13B), tab-and-slot closures (FIG. 13C), snaps (FIG. 13D), stick-on magnetic closures (FIG. 13E), micro hook-and-loop closures, such as Velcro®-brand closures (FIG. 13G), and conventional button/buttonhole closures (FIG. 13G).
Figure 13B:
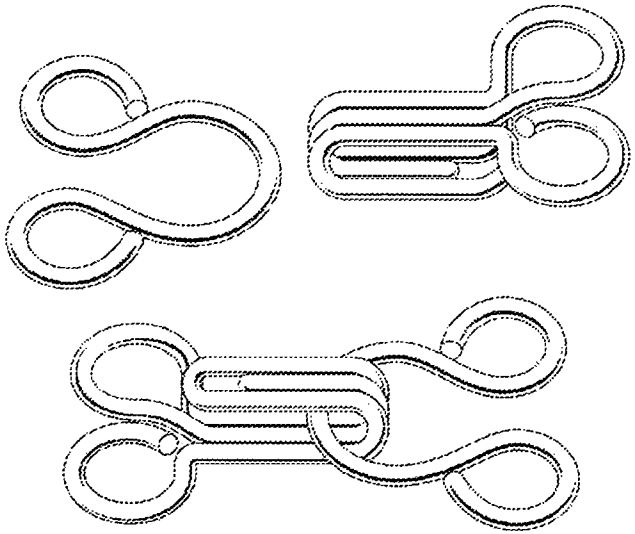
Figure 13C:
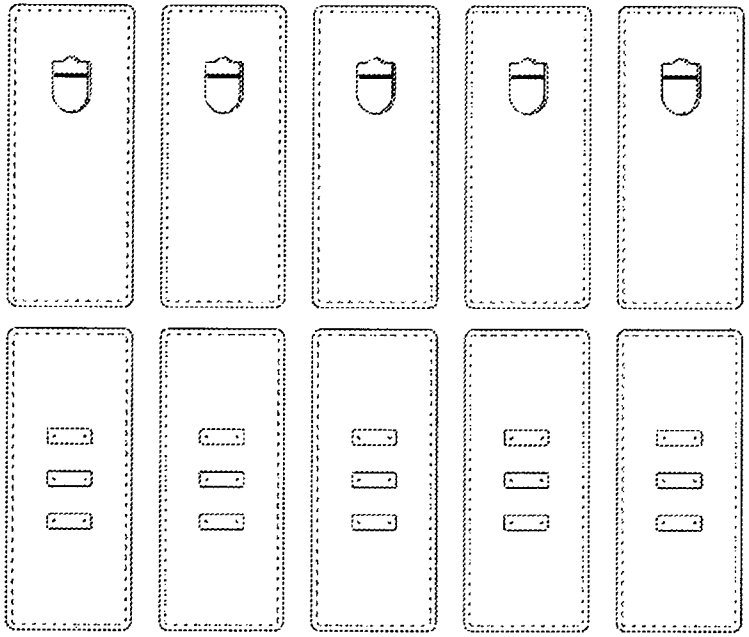
Figure 13D:
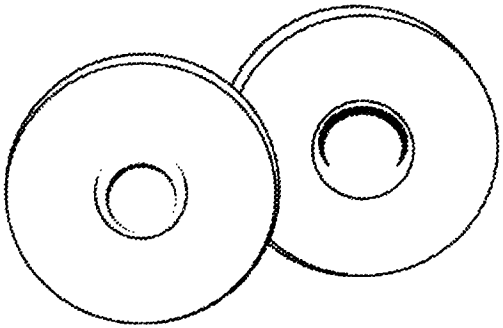
Figure 13E:
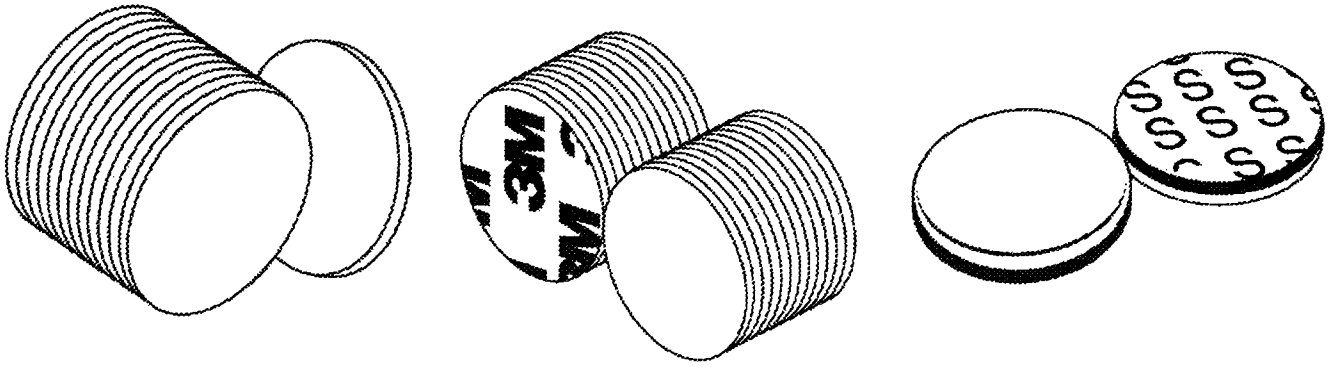
Figure 13F:
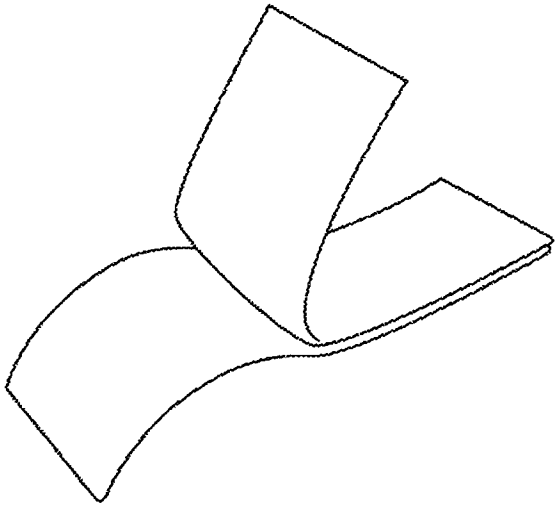
Figure 13G:
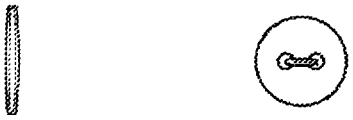

FIGS. 13A through 13G show various types of placket closures that can be used in the shirt disclosed herein. FIG. 13A shows various types of "no sew" snap closures and adhesive snap-buckle closures. FIG. 13B shows hook-and-loop closures. FIG. 13C shows tab-and-slot closures. FIG. 13D shows a snap-cap closure. FIG. 13E shows magnetic closures. FIG. 13F shows a Velcro®-type hook and loop closure. FIG. 13G shows a button and corresponding buttonhole closure.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The definitions of the words or drawing elements described herein are meant to include not only the combination of elements which are literally set forth, but all equivalent structures, materials or acts for performing substantially the same function in substantially the same way to obtain substantially the same result. In this sense, it is therefore contemplated that an equivalent substitution of two or more elements may be made for any one of the elements described and its various embodiments or that a single element may be substituted for two or more elements in a claim.

The embodiments described in detail above are considered novel over the prior art of record and are considered critical to the operation of at least one aspect of the invention and to the achievement of the above-described objectives. The words used in this specification to describe the instant embodiments are to be understood not only in the sense of their commonly defined meanings, but to include by special definition in this specification: structure, material or acts beyond the scope of the commonly defined meanings. Thus, if an element can be understood in the context of this specification as including more than one meaning, then its use must be understood as being generic to all possible meanings supported by the specification and by the word or words describing the element.

The scope of this description is to be interpreted only in conjunction with the appended claims and it is made clear, here, that the named inventor believes that the claimed subject matter is what is intended to be patented.

REFERENCES

| Patent No. | Pub. Date | Inventor |
|---|---|---|
| 146,175 | January 1874 | Flynt |
| 148,193 | March 1874 | Dunbar |
| 388,075 | August 1888 | Saegar |
| 510,639 | December 1893 | Ganson |
| 730,137 | June 1903 | Livingston |
| 925,121 | June 1909 | Melze |
| 932,640 | August 1909 | Pfiffner |
| 948,199 | May 1910 | Anderson |
| 959,441 | May 1910 | Anderson |
| 1,199,689 | September 1916 | Gewandter |
| 1,764,212 | June 1930 | Kirsten |
| 1,883,341 | October 1932 | Dauphinais |
| 1,998,085 | April 1935 | Kahn |
| 2,306,088 | December 1942 | Spanney |
| 2,585,689 | February 1952 | Schafer |
| 2,646,570 | July 1953 | Rinehart |
| 2,671,222 | March 1954 | Hochberg |
| 2,893,012 | July 1959 | Kahn |
| 3,142,843 | August 1964 | Berger |
| 3,418,659 | December 1968 | Brown |
| 3,394,437 | July 1968 | Sinclair |
| 4,074,364 | February 1978 | Lucero |
| 4,596,569 | June 1986 | Campbell |
| 4,597,109 | July 1986 | Hironaga |
| 4,481,682 | November 1984 | Hall |
| 4,853,979 | August 1989 | Ryder |
| 4,937,886 | July 1990 | Ellis |
| 5,033,121 | July 1991 | Larsen |
| 5,515,544 | May 1996 | Hosking |
| 5,177,813 | January 1993 | Bosack |
| 5,177,814 | January 1993 | Courtney |
| 5,276,923 | January 1994 | Cohen |
| 5,488,738 | February 1996 | Seamans |
| 5,682,619 | November 1997 | Griffin |
| 5,774,899 | July 1998 | Griffin |
| 6,026,516 | February 2000 | Dacyshyn |
| 6,167,573 | January 2001 | Lewis |
| 6,959,455 | November 2005 | Hall |
| 7,398,558 | July 2008 | Kattenhorn |
| 7,412,730 | August 2008 | Schroeder |
| 8,065,747 | November 2011 | Keeter |
| 8,291,515 | October 2012 | Carter |
| 8,209,779 | August 2012 | Herman |
| 8,601,615 | December 2013 | Isaacson |
| 8,631,517 | January 2014 | Blakely |
| 8.769,780 | July 2014 | Segel |
| 8,832,866 | September 2015 | Herman |
| 9,049,895 | June 2015 | Wesol |
| 9,339,071 | May 2016 | Herman |
| 9,538,791 | January 2017 | O'Donnell |
| 9,913,505 | March 2018 | Wilson |
| 9,924,752 | March 2018 | Horrey |
| 9,603,400 | March 2017 | Kenney |
| 10,039,328 | August 2017 | English |
| 10,051,904 | August 2018 | Isaacson |
| 10,165,815 | January 2019 | Branker |
| 10,251,432 | February 2017 | Kenney |
| 10,842,200 | November 2020 | Colon |
| 2003/0135910 | July 2003 | Young, Jr. |
| 2006/0010559 | January 2006 | Hamlet |
| 2006/0048266 | March 2006 | Kim |

-continued

REFERENCES

| Patent No. | Pub. Date | Inventor |
|---|---|---|
| 2006/0185056 | August 2006 | Zwick |
| 2010/0235969 | September 2010 | Isaacson |
| 2011/0197335 | August 2011 | Handy |
| 2013/0239284 | September 2013 | Zamponi |
| 2013/0247280 | August 2013 | Haggard |
| 2014/0304899 | October 2014 | Almonte |
| 2014/0338091 | May 2014 | Kenney |
| 2015/0101109 | April 2015 | Herman |
| 2015/0135399 | May 2015 | O'Donnell |
| 2015/0230531 | August 2015 | Merchen |
| 2016/0100634 | April 2016 | Rogers |
| 2016/0338415 | November 2016 | Aihara |
| 2017/0095024 | June 2017 | Bassin |
| 2017/0143052 | May 2017 | Kenney |
| 2017/0202288 | July 2017 | O'Donnell |
| 2017/0231287 | August 2017 | O'Donnell |
| 2017/0325511 | November 2017 | Kim |
| 2017/0238637 | August 2017 | O'Donnell |
| 2018/0213851 | August 2018 | O'Donnell |
| 2019/0254352 | August 2019 | Berkowitz |
| 2020/0253288 | August 2020 | O'Donnell |
| D847,468 | May 2019 | Genao |
| D913,643 | March 2021 | Tinch |

What is claimed is:

1. A shirt comprising:

(a) a back panel;

(b) at least two sleeve panels;

(c) one or two front panels having at least an inner placket and an outer placket, wherein the outer placket comprises at least three placket closures, and the inner placket comprises a corresponding number of mating placket closures;

(d) a collar with a corresponding collar closure, wherein one of the at least three placket closures is nearest to the collar closure;

(e) one and only one anti-flap placket closure attached to, disposed on, or defined in the inner and outer plackets at a point between the collar closure and the placket closure nearest the collar closure; and (f) indicia on the shirt that is visible to an observer or purchaser, wherein the indicia indicates that the shirt is to be worn while piloting a motorcycle or speed boat.

2. The shirt of claim 1, wherein the anti-flap placket closure is selected from the group consisting of a male/female button-snap closure, a snap-button closure, a single hook and loop closure, a Velcro®-type hook-and-loop closure, a magnetic closure, and a button-and-buttonhole closure.

3. The shirt of claim 1, wherein the anti-flap placket closure is dimensioned and configured to be hidden from frontal-view when the anti-flap placket closure is in a closed position.

4. The shirt of claim 1, wherein the anti-flap placket closure is of a different type than the at least three placket closures.

5. The shirt of claim 1, wherein the anti-flap placket closure is attached to the inner and outer plackets via sewing thread or adhesive.

* * * * *